United States Patent [19]

Chen

[11] Patent Number: 4,714,805

[45] Date of Patent: Dec. 22, 1987

[54] SELECTIVE SWITCH

[75] Inventor: Sun C. Chen, Taipei, Taiwan

[73] Assignees: Turn-Luckily Intl., Ltd., Huntington Beach, Calif.; Hozn Auto & Soft Co., Ltd., Taipei, Taiwan

[21] Appl. No.: 896,718

[22] Filed: Aug. 15, 1986

[51] Int. Cl.[4] ..... H01H 15/06

[52] U.S. Cl. ..... 200/16 A; 200/153 P

[58] Field of Search ..... 200/16 R, 16 A, 16 B, 200/16 C, 16 D, 16 E, 16 F, 153 P

[56] References Cited

U.S. PATENT DOCUMENTS 3,592,982 7/1971 Deltoer ..... 200/16 R
4,316,067 2/1982 Whiteman, Jr. ..... 200/16 R X
4,417,107 11/1983 Terajima ..... 200/16 C

FOREIGN PATENT DOCUMENTS 625040 9/1961 Italy ..... 200/16 C

*Primary Examiner*—J. R. Scott
*Assistant Examiner*—Morris Ginsburg
*Attorney, Agent, or Firm*—Birch, Stewart, Kolasch & Birch

[57] ABSTRACT

An improved selective switch includes a printed circuit board, a rotating shaft with a pinion, two bearings journalling the rotating shaft on the printed circuit board, a sliding member slidably mounted on the printed circuit board and a rack meshed with the pinion, thereby, when the rotating shaft is rotated, by the linking-up motion of the rack and the pinion, the sliding member will be driven to slide on the printed circuit board so that the selective control of the selective switch is achieved.

5 Claims, 6 Drawing Figures

SELECTIVE SWITCH

BACKGROUND OF THE INVENTION

The invention relates to a selective switch, particularly to a selective switch with a sliding member slidable on a printed circuit board for selective control of the switch.

Referring to FIG. 1, a conventional rotary selective switch includes a plurality of hubs 10 each of which is provided with a conductive reed fixed thereon, a plurality of partitions 20 with contacts, two opposing support rods 40 and 41 securely connecting the partitions 20, a rotary knob 30, a rotating shaft 301 rotatable synchronously with the hubs 10 so that the conductive reeds secured on the hubs 10 contact selectively the contacts of partitions 20, and a positioning device including a positioning plate 302 with a plurality of circumferential slots and a steel ball 303 received detachably in one of the slots. As illustrated, a plurality of electric cords are necessary for connecting connectors to the contacts of the partitions 20. The prior art is difficult to weld and thus easy to make a mistake in assembling. When increase in the number of contacts is desired, the number of the partitions 20 and the length of the rotating shaft 301 must be increased. Then, the torsion of the rotating shaft 301 results in a certain shock at the end portion of the rotating shaft 301 so that the reeds can not easily register the contacts at the end portion of the rotating shaft when rotating. In addition to the poor contact, the operation of the positioning device is difficult due to the tight snap fitting of the steel ball 303 into the slots.

SUMMARY OF THE INVENTION

An object of the invention is to provide an improved selective switch with a positive contact, which is easy to be assembled and operated.

According to the invention, an improved selective switch includes a printed circuit board, including a circuit having two spaced-apart contacts; a rotating shaft, including a pinion fixed thereon; two bearings, journalling said rotating shaft on said printed circuit board; and a first sliding member, slidably mounted on said printed circuit board, including two spaced-apart conductive portions fixed thereon, and a rack meshed with said pinion for driving said conductive portions of said first sliding member to slide between said two spaced-apart contacts on said printed circuit board for alternative connection and disconnection of said two spaced-apart contacts; whereby, when said rotating shaft is rotated, by means of the linking-up motion of said pinion and said rack, said first sliding member will be driven to slide on said printed circuit board so that the selective control of said selective switch is achieved. The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
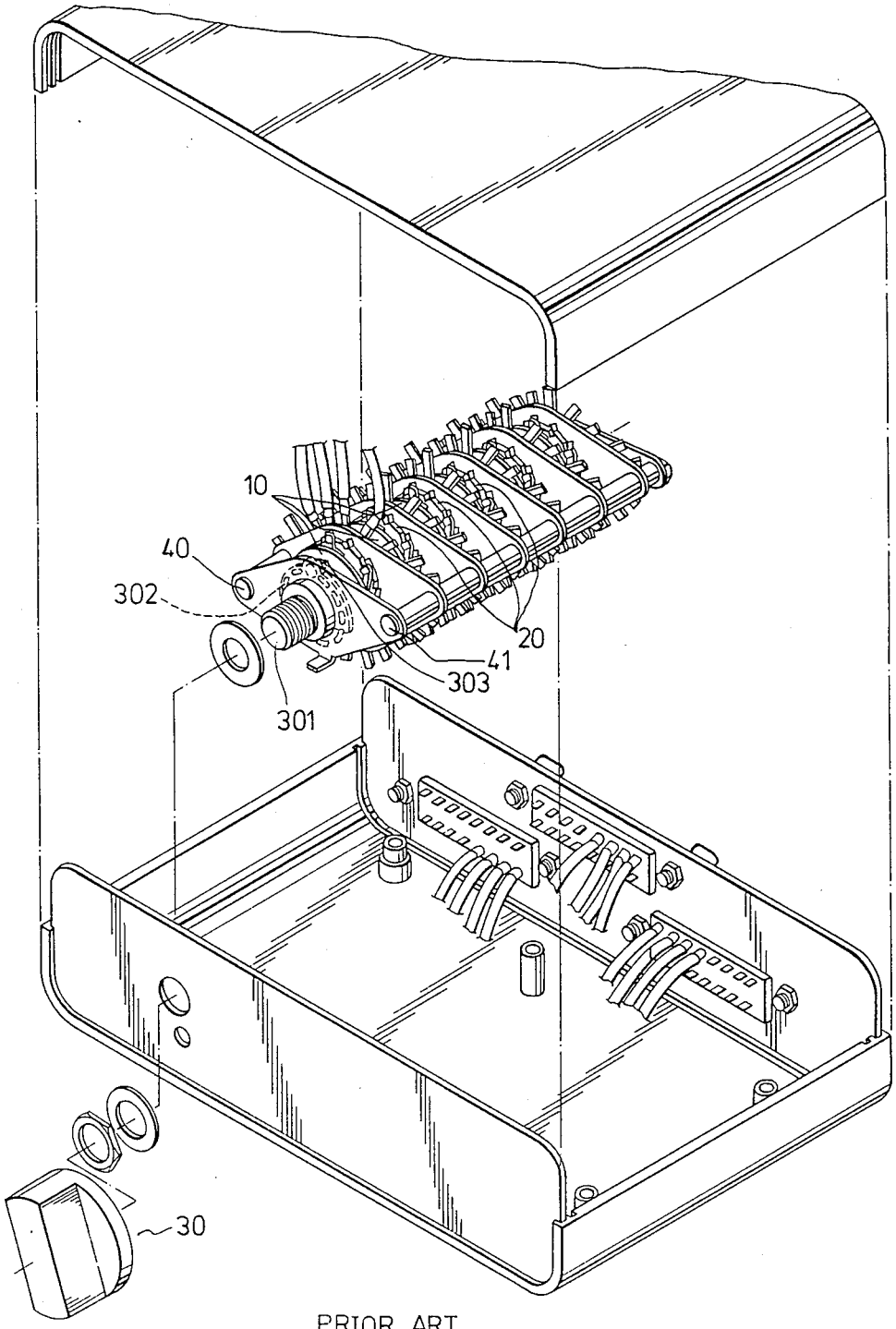
PRIOR ART FIG. 1
FIG. 1 is a partially exploded view showing a selective switch according to prior art.
Figure 2:
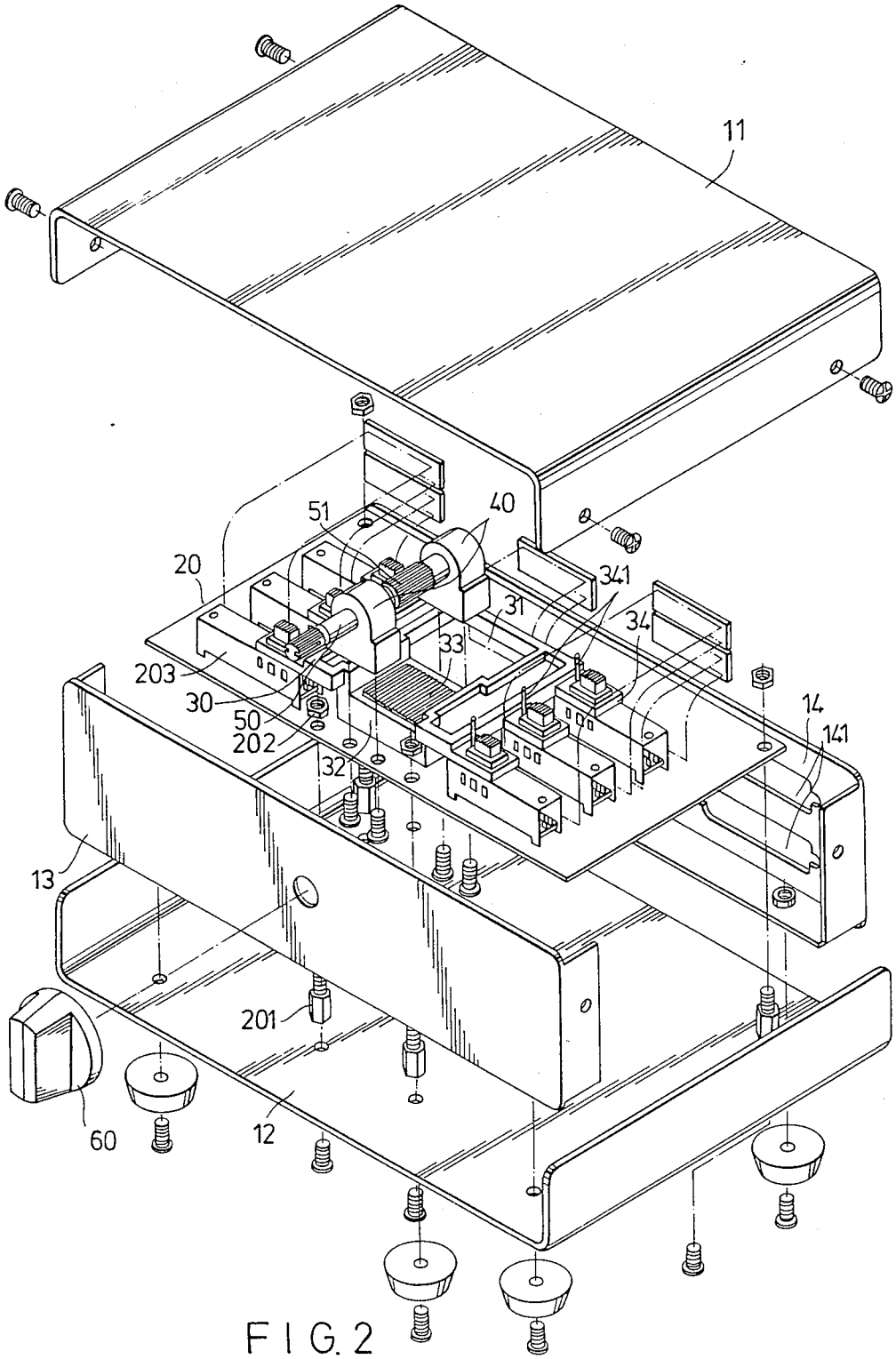
FIG. 2 is a partially exploded view showing a selective switch according to the invention.
Figure 3:
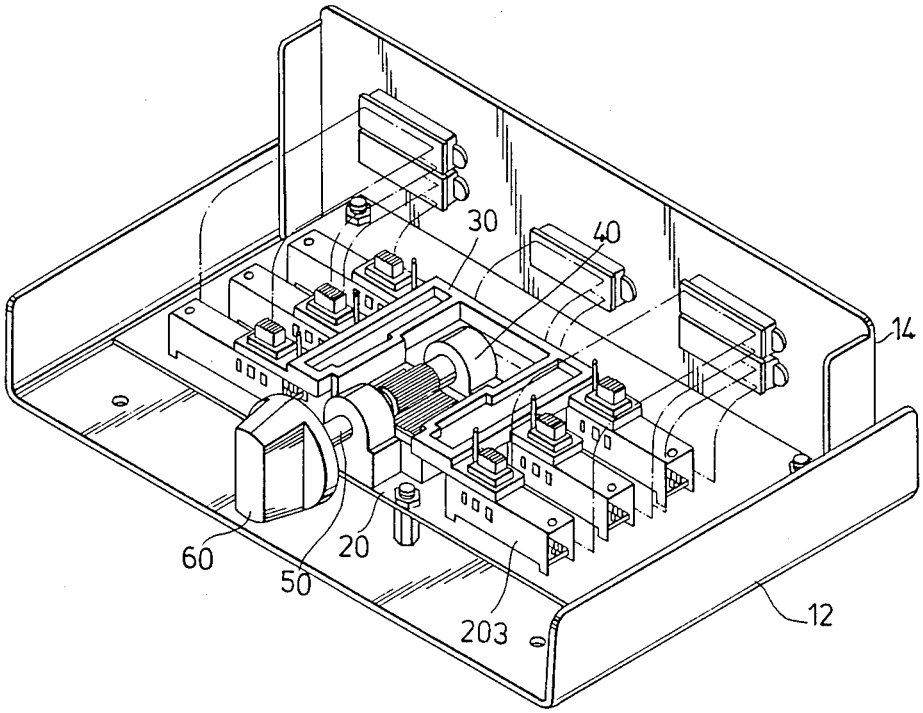
FIG. 3 is a perspective view showing the selective switch of FIG. 2.

Referring to FIG. 2, a selective switch according to the invention includes basically a housing, a printed circuit board 20, an injection-molded plastic first sliding member 30, two bearings 40, a rotating shaft 50 and a rotary knob 60.

The housing includes an upper housing 11, a lower housing 12, a front housing 13 and a rear housing 14 with a plurality of holes 141 on which connectors (not shown) are mounted. They are assembled together by screws.

The printed circuit board 20 is secured to the housing by bolts 201 and nuts 202. It has a circuit connected to the connectors by a plurality of electric cords in order (shown in broken lines) through spot welding for preventing confusion of the electric cords in arrangement. In addition, it includes six inverted U-shape mounting members 203 fixed on the circuit board.

Figure 5:
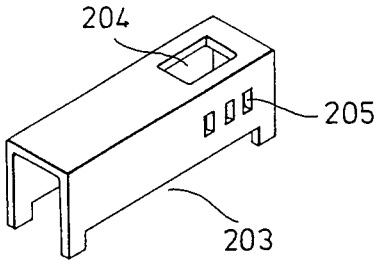
FIG. 5 is a perspective view showing a mounting member of the selective switch of FIG. 2.

Referring to FIG. 5, each of the mounting members 203 includes a guide slot 204 in the upper surfaces thereof and three aligned positioning slots 205 in one of the side walls thereof.

Figure 6:
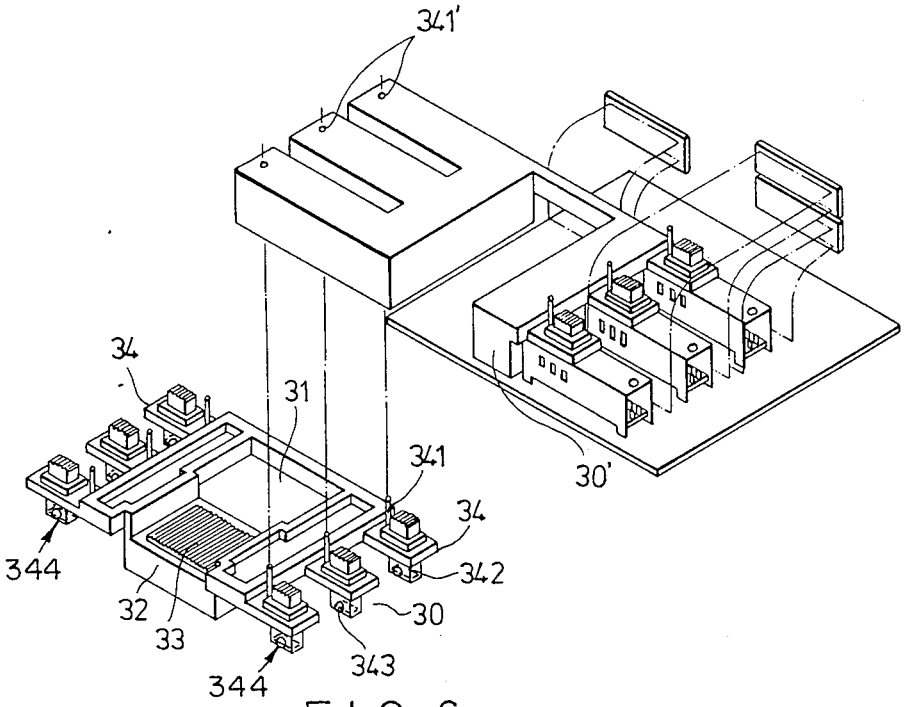
FIG. 6 is an exploded view of FIG. 4.

The first sliding member 30, as shown in FIG. 6, includes a generally rectangular body, a central opening 31, a depressed base portion 32 adjacent to the central opening 31, a rack 33 on that base portion 32, and six fingers 34 projecting from two sides of the sliding member 30. Each finger 34 includes a projecting post 341 on an upper surface thereof and a downward insert block 342 carrying a metal sheet 344 at the bottom surface of the block 342, and a spring biased ball 343 flush with the three aligned positioning slots 205 of the mounting member 203. Accordingly, when the first sliding member 30 is slid on the printed circuit board 20, the insert blocks 342 are received slidably in the guide slots 204, the first sliding member 30 is capable of being positioned at three predetermined positions by the engagement of the spring biased balls 343 and the three positioning slots 205, that is, the switch has three selective positions.

The rotating shaft 50 with the rotary knob 60 at the outer end thereof is journalled by the two bearings 40 which are close to two sides of the depressed base portion 32 on the printed circuit board 20. One of the bearings 40 thus passes through the central opening 31. Integrally formed on the rotating shaft 50 is a pinion 51 meshed with the rack 33 of the first sliding member 30 for driving the first sliding member 30 to slide on the printed circuit board 20 when the rotating shaft 50 is rotated by actuating the rotary knob 60.

In operation, since the first sliding member 30 has the base portion 32 lying on the printed circuit board 20 and six insert blocks 342 horizontally slidably inserted into the guide slots 204 of the mounting member 203, and, at the same time, the rack 33 is meshed with the pinion 51 of the rotating shaft 50 and is sandwiched between the rotating shaft 50 and the printed circuit board 20, the metal sheet 344 of the insert blocks 342 can connect respectively, positively, and easily to relative contacts in the mounting member 203 through linking-up motion of the rotating shaft 50 and the first sliding member 30 after the rotary knob 60 is actuated.

Figure 4:
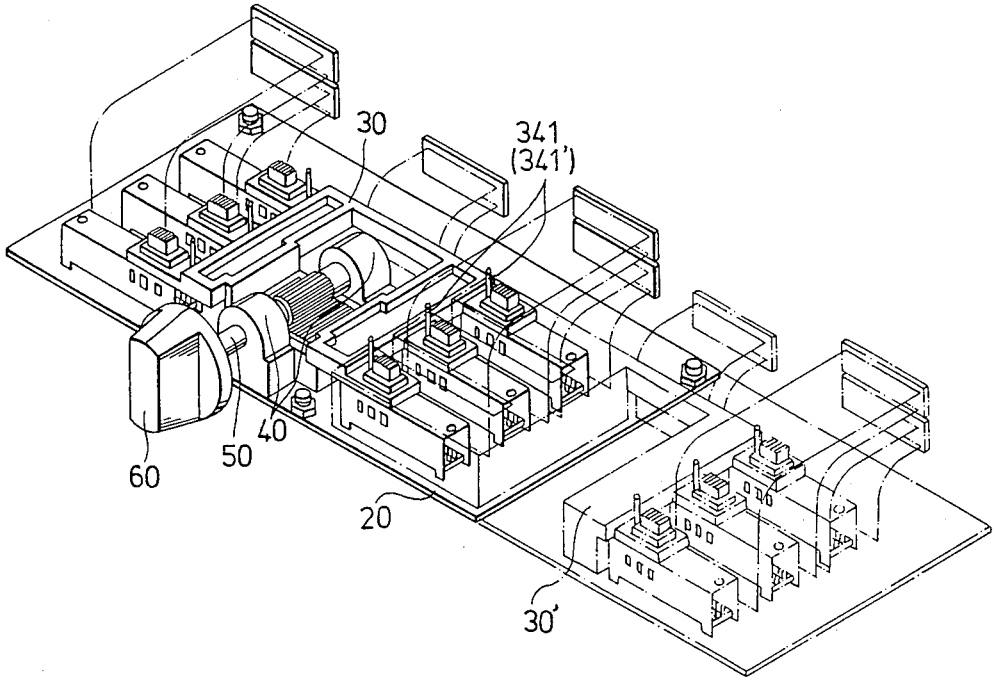
FIG. 4 is a schematic view showing an enlarged form of the selective switch of FIG. 2 with more contacts.

When the increase in the number of contacts is desired, as shown in FIGS. 4 and 6, a second sliding member 30' with a plurality of holes 341' opposing the projecting posts 341 of the first sliding member 30 is connected to the first sliding member 30 by the engagement of the holes 341' and the projecting posts 341. It is understood that the printed circuit board 20 must be elongated. It is obvious that in case of increasing the contacts the selective switch according to the invention is more practical than the above described prior rotary switch.

With the invention thus explained, it is apparent that various modifications and variations can be made without departing from the scope of the invention. It is therefore intended that the invention be limited as indicated in the appended claims.

What is claimed is:

1. An improved selective switch comprising:

a printed circuit board, including a circuit and including at least two sets of spaced-apart contacts;

a rotating shaft, including a pinion fixed thereon;

two bearings, journalling said rotating shaft proximate to said printed circuit board; and a first sliding member movable in a first direction, slidably mounted on said printed circuit board, including at least two sets of at least two spaced-apart conductive portions fixed thereon, each of said at least two conductive portions of each of said sets being spaced relative to one another in a second direction, said second direction being generally perpendicular to said first direction, and a rack fixed thereon and meshed with said pinion of said rotating shaft for driving said at least two sets of conductive portions of said first sliding member in said first direction so as to slide between said at least two sets of spaced-apart contacts on said printed circuit board for alternative connection and disconnection with respective ones of said at least two sets of spaced-apart contacts;

whereby when said rotating shaft is rotated, by means of the linking-up motion of said pinion and said rack, said first sliding member will be driven to slide on said printed circuit board so that the selective control of said selective switch is achieved.

2. The improved selective switch as claimed in claim 1, wherein said first sliding member includes a plurality of fingers projecting from each of two sides thereof, each of said fingers including an insert block, and wherein each of said at least two conductive portions of said first sliding member is a metal sheet carried on a bottom surface of each of said insert blocks.

3. The improved selective switch as claimed in claim 2, wherein said printed circuit board includes an inverted U-shaped mounting member fixed above said at least two spaced-apart contacts of said printed circuit board and provided with a guide slot in an upper surface of said mounting member, into which one of said insert blocks is inserted, so that said first sliding member is mounted slidably on said printed circuit board by said mounting member.

4. The improved selective switch as claimed in claim 3, wherein each of said insert blocks includes a spring biased ball carried on a slide wall thereof, and wherein said mounting member includes a plurality of aligned spaced-apart positioning slots flush with said spring biased ball in a side wall of said mounting member opposing said spring biased ball, whereby, when said spring biased ball engages one of said positioning slots, said first sliding member is positioned.

5. An improved selective switch comprising:

a printed circuit board, including a circuit and including at least two spaced-apart contacts;

a rotating shaft, including a pinion fixed thereon;

two bearings, journalling said rotating shaft proximate to said printed circuit board;

a first sliding member, slidably mounted on said printed circuit board, including two spaced-apart conductive portions fixed thereon, and a rack fixed thereon and meshed with said pinion of said rotating shaft for driving said conductive portions of said first sliding member to slide between said two-spaced apart contacts on said printed circuit board for alternative connection and disconnection of said two spaced-apart contacts; and a second sliding member having a plurality of holes, and wherein said first sliding member includes a plurality of projecting posts insertable into holes so that said first and second sliding members can be attached to each other;

whereby, when said rotating shaft is rotated, by means of the linking-up motion of said pinion and said rack, said first sliding member will be driven to slide on said printed circuit board so that the selective control of said selective switch is achieved.

* * * * *